US010862218B2

(12) United States Patent
Carlson

(10) Patent No.: US 10,862,218 B2
(45) Date of Patent: Dec. 8, 2020

(54) VIVALDI NOTCH WAVEGUIDE ANTENNA

(71) Applicant: James Carlson, Comstock Park, MI (US)

(72) Inventor: James Carlson, Comstock Park, MI (US)

( * ) Notice: Subject to any disclaimer, the term of this patent is extended or adjusted under 35 U.S.C. 154(b) by 0 days.

(21) Appl. No.: 16/446,626

(22) Filed: Jun. 20, 2019

(65) Prior Publication Data

US 2020/0161774 A1 May 21, 2020

Related U.S. Application Data

(60) Provisional application No. 62/687,345, filed on Jun. 20, 2018.

(51) Int. Cl.

| | |
|---|---|
| ***H01Q 1/32*** | (2006.01) |
| ***H01Q 21/06*** | (2006.01) |
| ***H01Q 13/08*** | (2006.01) |

(52) U.S. Cl.
CPC ..... *H01Q 21/064* (2013.01); *H01Q 13/085* (2013.01)

(58) Field of Classification Search
CPC ..... H01G 21/064; H01G 13/085
See application file for complete search history.

(56) References Cited

U.S. PATENT DOCUMENTS

| | | | |
|---|---|---|---|
| 5,036,335 | A | 7/1991 | Jairam |
| 5,600,332 | A | 2/1997 | Brown et al. |
| 6,518,931 | B1 | 2/2003 | Sievenpiper |
| 6,525,696 | B2 | 2/2003 | Powell et al. |
| 6,839,036 | B1 | 1/2005 | Apostolos et al. |
| 6,842,154 | B1 | 1/2005 | Apostolos |
| 6,900,770 | B2 | 5/2005 | Apostolos |
| 7,088,300 | B2 | 8/2006 | Fisher |
| 7,498,995 | B2 | 3/2009 | Kim et al. |
| 8,504,135 | B2 | 8/2013 | Bourqui et al. |
| 8,730,116 | B2 | 5/2014 | Peng et al. |
| 8,736,506 | B1 | 5/2014 | Brock et al. |
| 9,054,427 | B2 | 6/2015 | Guy et al. |
| 9,257,747 | B2 | 2/2016 | Flores-Cuadras |
| 2005/0078043 | A1 | 4/2005 | Apostolos et al. |
| 2013/0038495 | A1 | 2/2013 | Benzel et al. |
| 2013/0278476 | A1 | 10/2013 | Peng et al. |
| 2013/0328738 | A1* | 12/2013 | Peng ..... H01Q 13/085 343/770 |
| 2014/0145890 | A1 | 5/2014 | Ramberg et al. |
| 2014/0253401 | A1 | 9/2014 | Peng et al. |
| 2016/0190691 | A1 | 6/2016 | Piskun |

FOREIGN PATENT DOCUMENTS

| | | | |
|---|---|---|---|
| WO | WO2005013413 | A2 | 2/2005 |
| WO | WO2015169394 | A1 | 11/2015 |

* cited by examiner

*Primary Examiner* — Graham P Smith
(74) *Attorney, Agent, or Firm* — Patrick Reilly

(57) ABSTRACT

An improved Vivaldi antenna enhances the performance over a 2:1 frequency band while occupying a compact format. Taking advantage of a common FR4 material printed circuit board construction, considered features are added which improve the operating bandwidth without adding additional cost. One such embodiment operates over an approximate frequency range of 400 to 900 MHz.

15 Claims, 11 Drawing Sheets

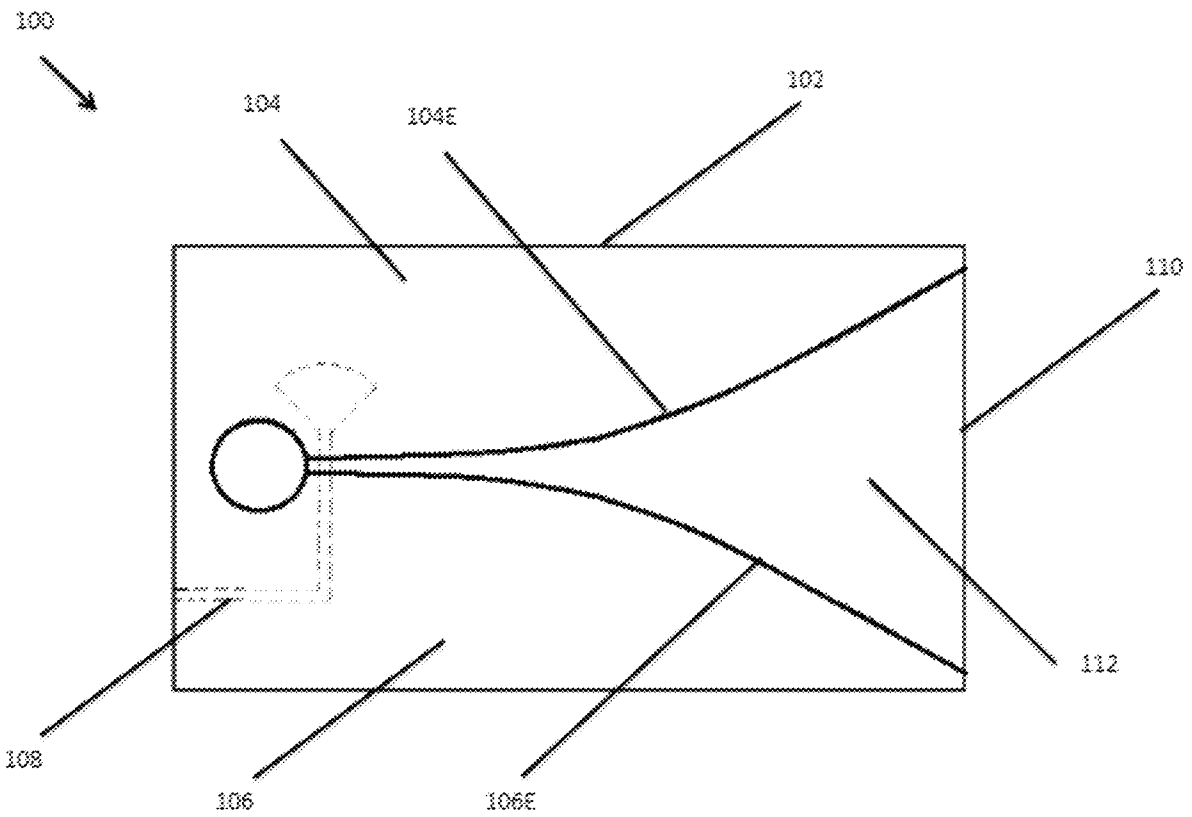
Figure 1 – Conventional Vivaldi antenna

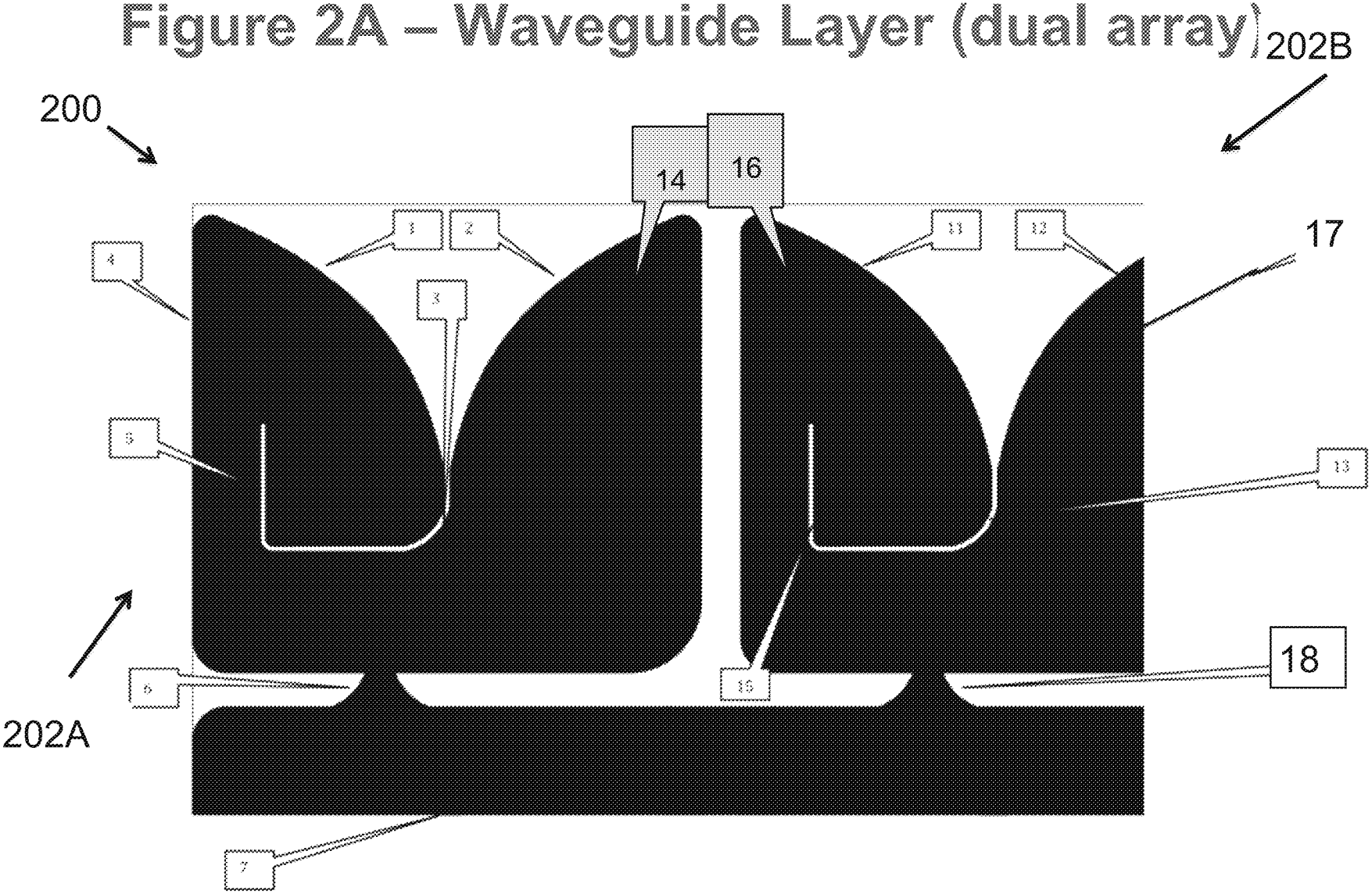
Figure 2A – Waveguide Layer (dual array)

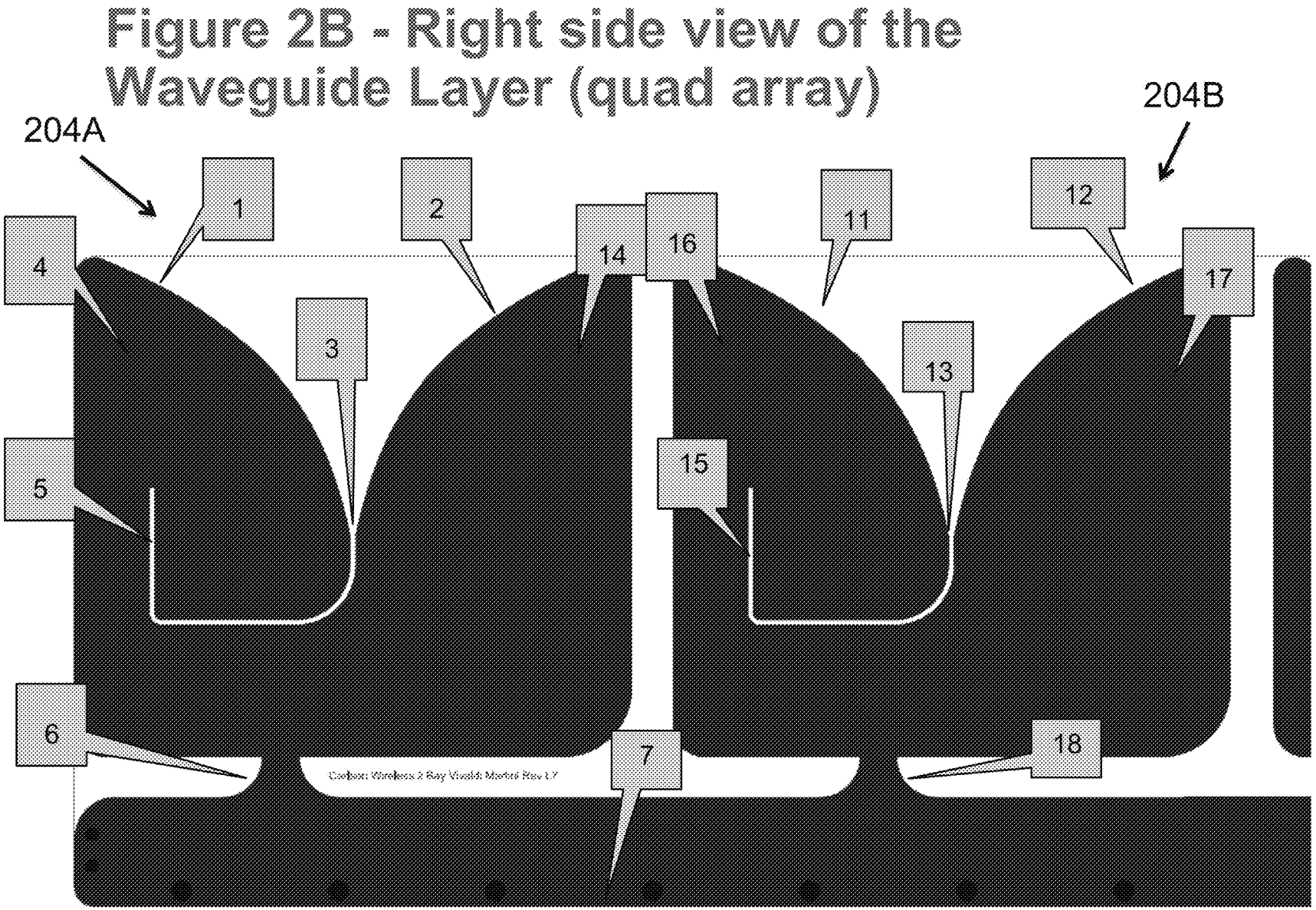
Figure 2B - Right side view of the Waveguide Layer (quad array)

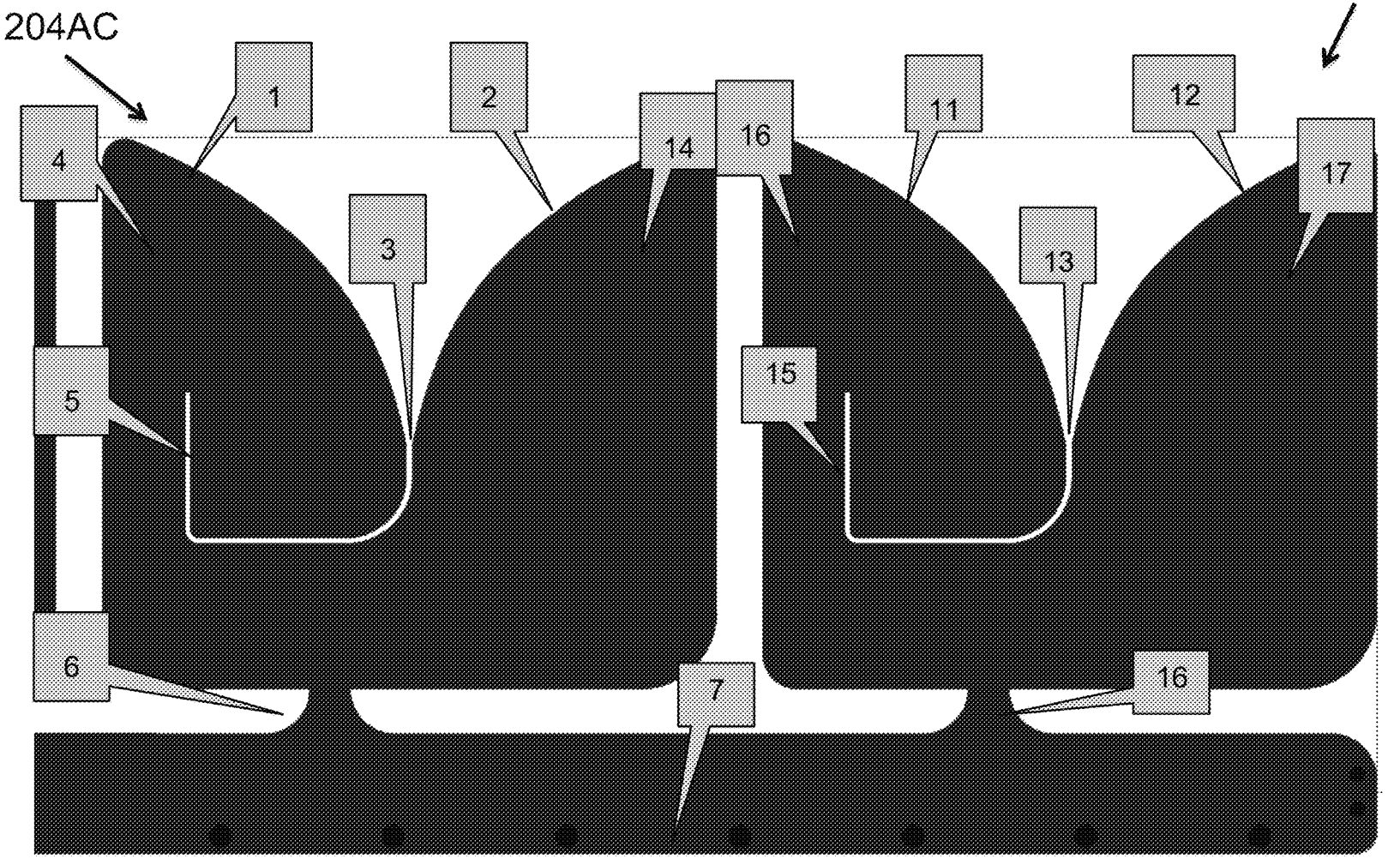
Figure 2C - Left side view of the Waveguide Layer (quad array)

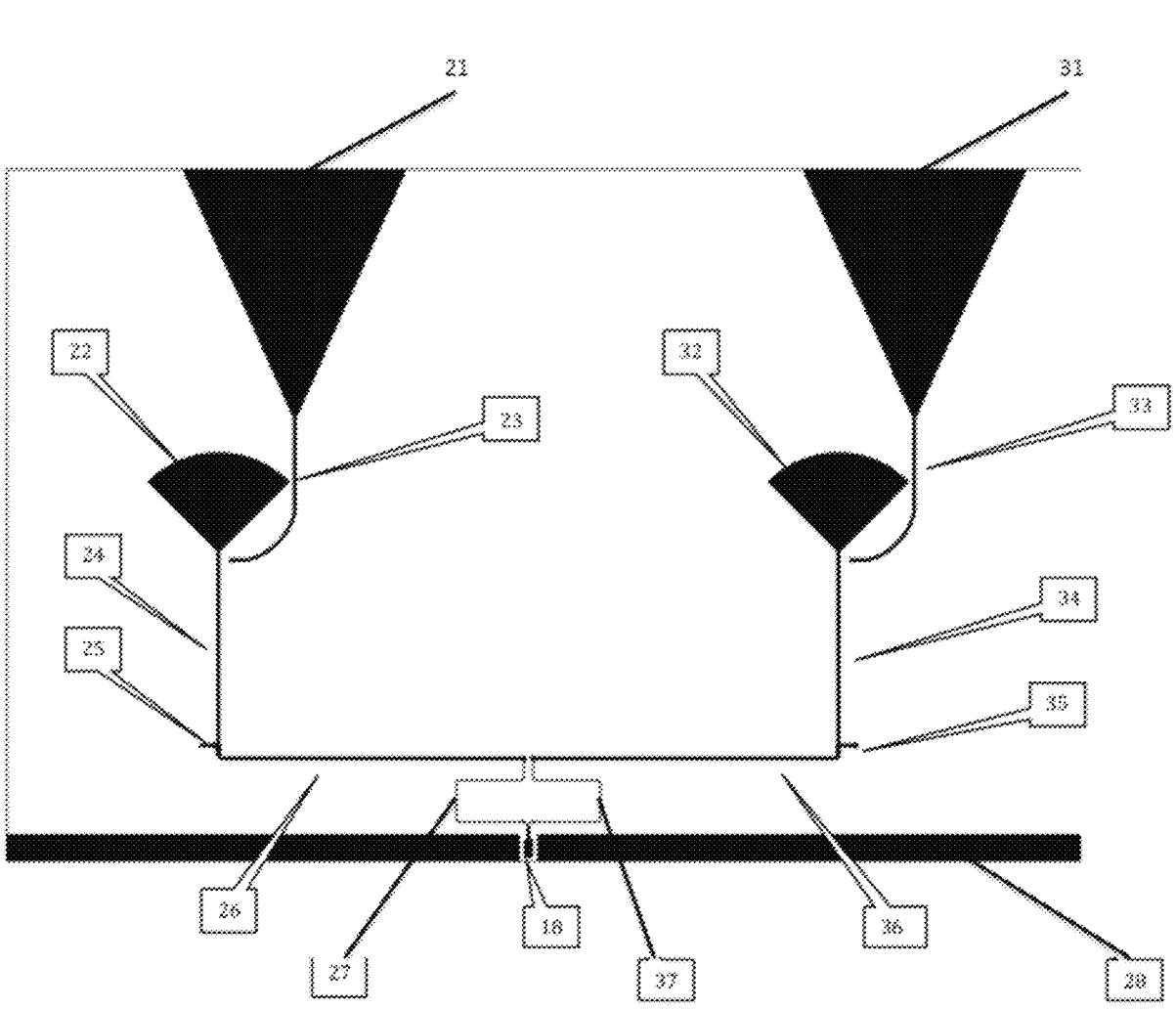
Figure 3A – Signal Layer (dual array)

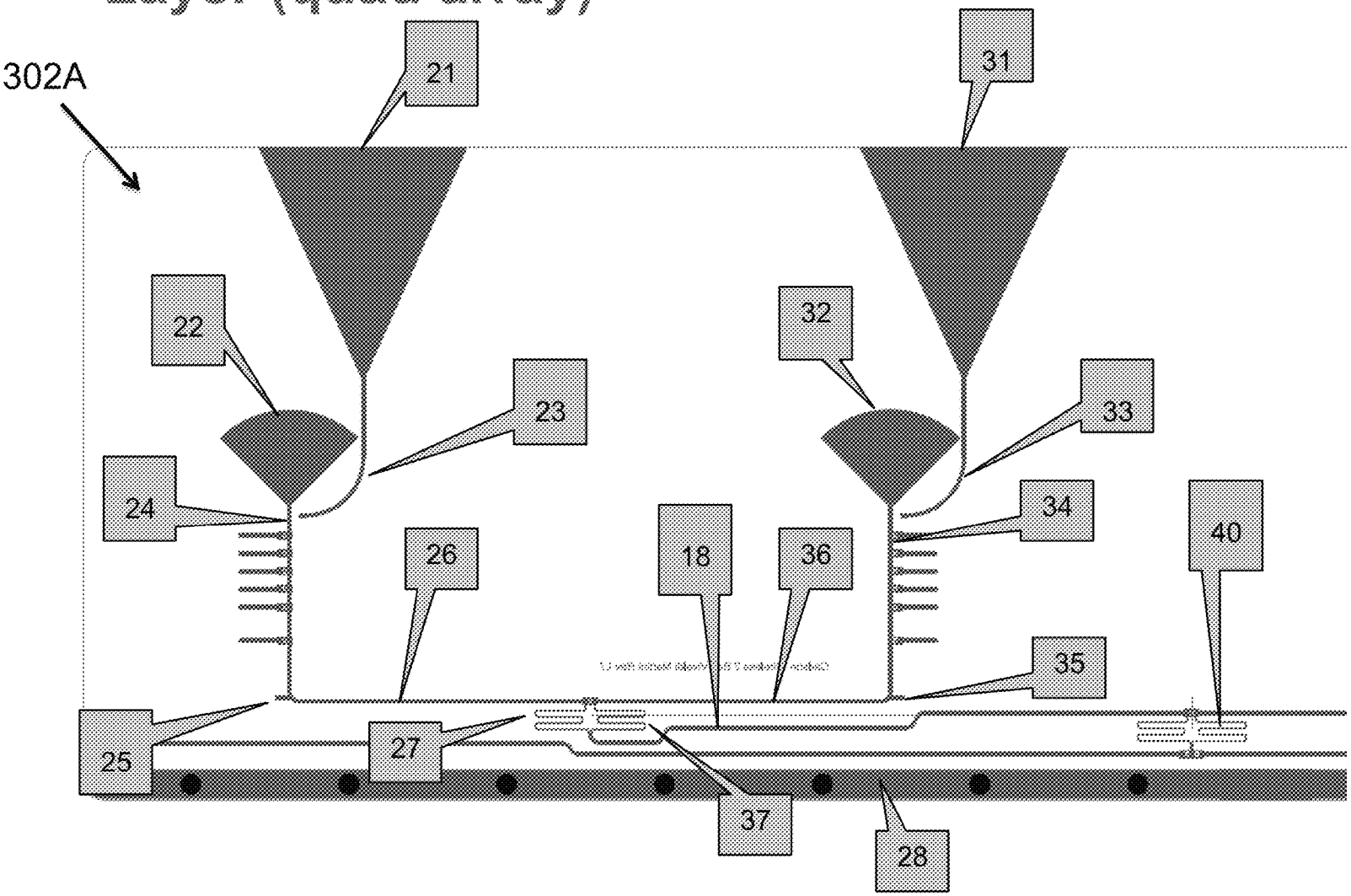
Figure 3B - Right side view of the Signal Layer (quad array)

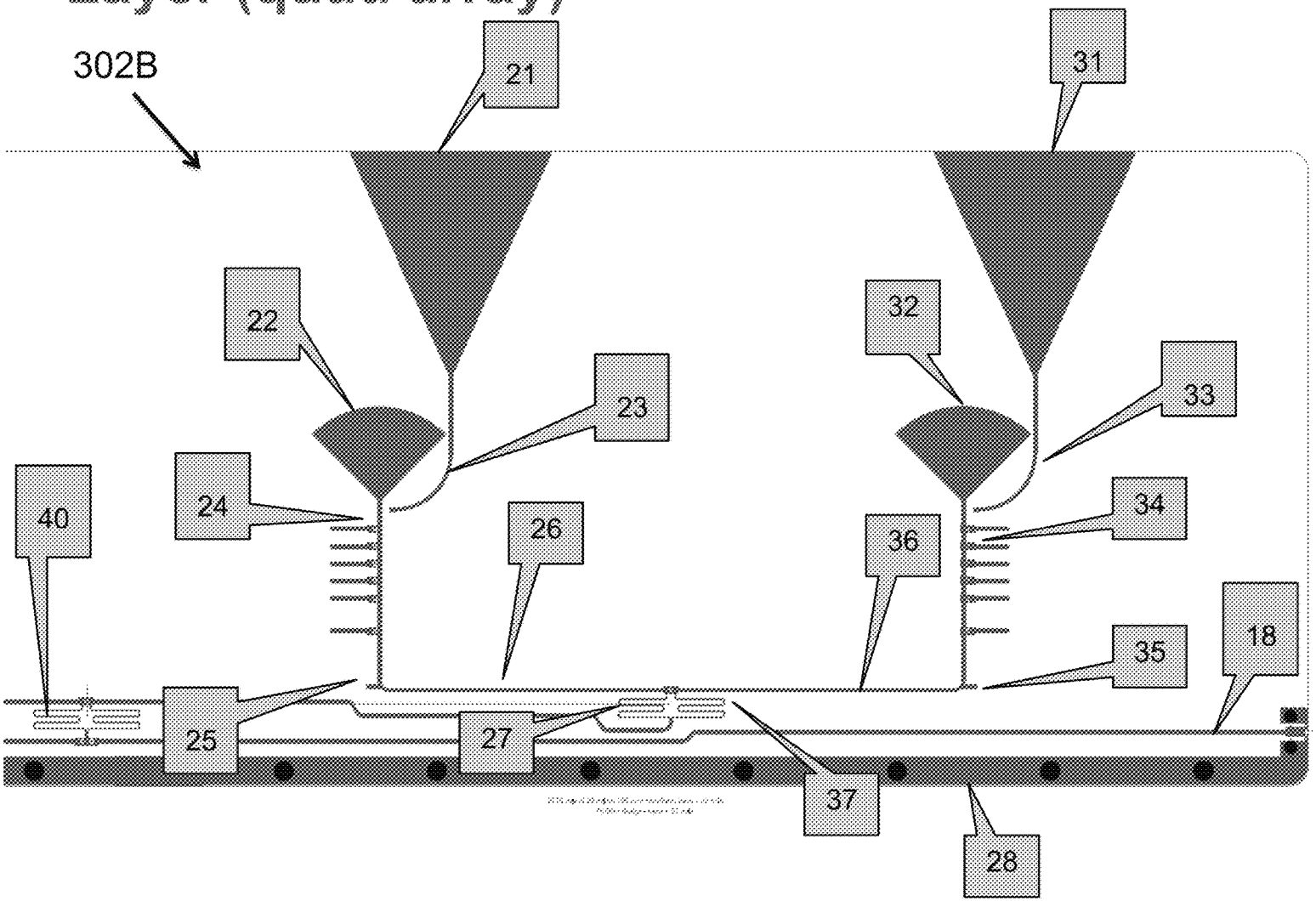
Figure 3C - Left side view of the Signal Layer (quad array)

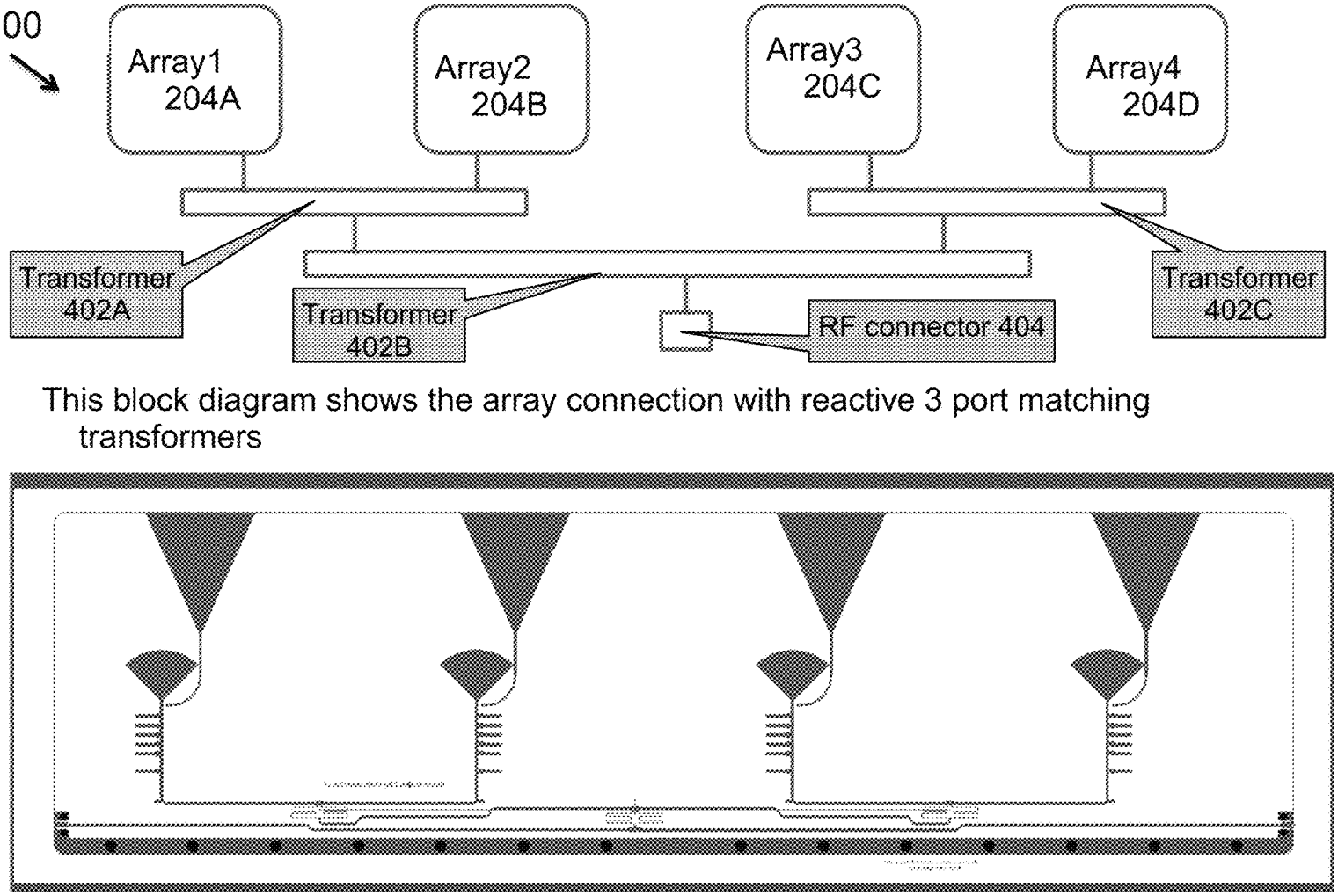
Figure 4 4-Bay Quad Array Modified Vivaldi

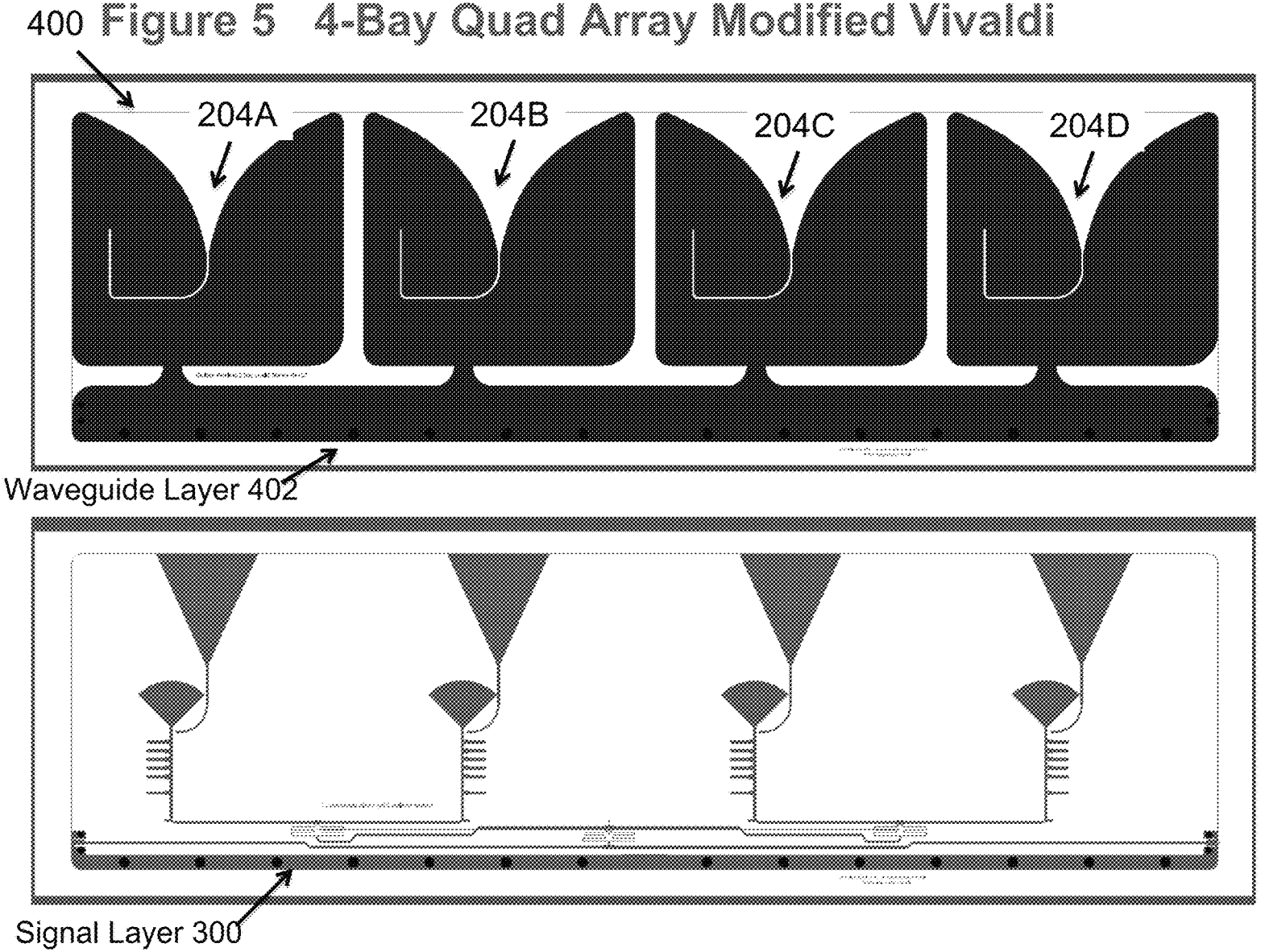
Figure 5 4-Bay Quad Array Modified Vivaldi

Quad element in a 120 degree backplane producing 8dBi

600

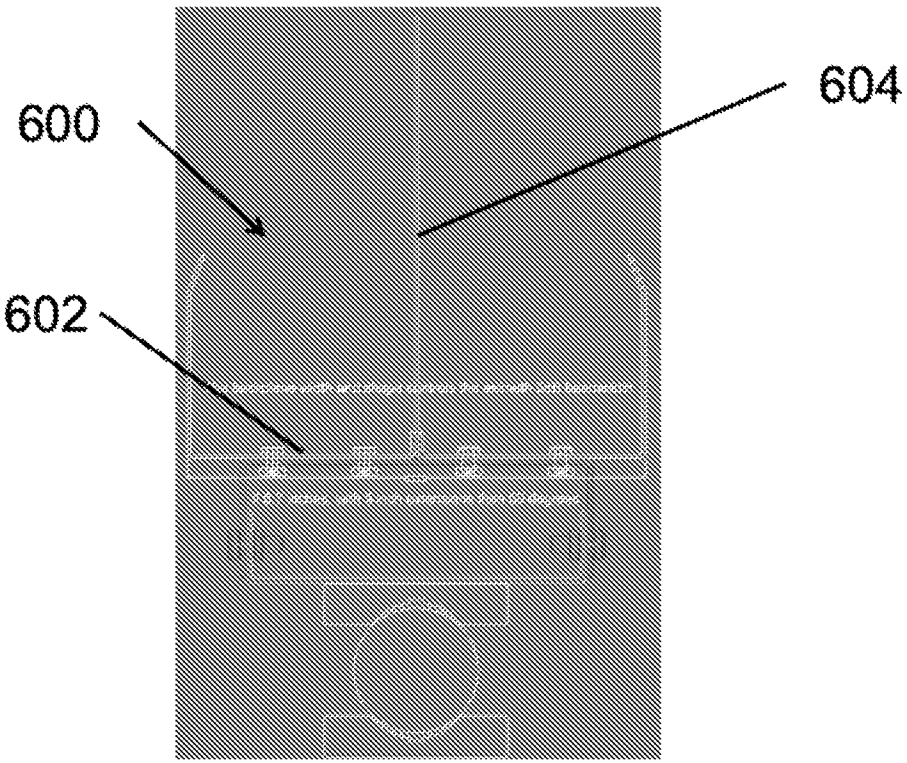
Figure 7 – Reflector Plate Assembly (top view)

VIVALDI NOTCH WAVEGUIDE ANTENNA

CO-PENDING PATENT APPLICATION

This Nonprovisional Patent Application is a Continuation-in-Part Patent Application to U.S. Provisional Patent Application Ser. No. 62/687,345 Titled VIVALDI NOTCH WAVEGUIDE ANTENNA as filed on Jun. 20, 2019 by Inventor James Carlson. Provisional Patent Application Ser. No. 62/687,345 is hereby incorporated by reference in its entirety and for all purposes, to include claiming benefit of the priority date of filing of Provisional Patent Application Ser. No. 62/687,345.

FIELD OF THE INVENTION

The present invention relates to wireless communications technology. More particularly, the present invention relates to the structure and design methods of wireless communications antennas.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

An antenna (plural antennae or antennas), or aerial, is an electrical device which converts electric power into radio waves, and vice versa. Antennae are usually used with a radio transmitter or radio receiver. In transmission, a radio transmitter supplies an electric current oscillating at radio frequency, i.e. a high frequency alternating current (AC)) to the antenna's input, and the antenna radiates a significant fraction of the energy from the current as electromagnetic waves (radio waves). In reception, an antenna intercepts some of the power of an electromagnetic wave in order to produce a tiny AC signal at its output that is applied to a receiver to be amplified.

Antennas are essential components of almost all wireless communications systems and are used in systems such as wireless routers, cellphone base stations, cell phones, radio broadcasting equipment, broadcast television systems, two-way radio sets, communications receivers, radars, cell phones, and satellite communications systems, as well as other devices such as garage door openers, wireless microphones, Bluetooth™-enabled devices, wireless computer networks, baby monitors, and RFID tags on merchandise.

The Vivaldi antenna type is particularly suitable for various applications of the method of the present invention. The Vivaldi antenna was presented by Gibson in 1979, (P. J. Gibson, The Vivaldi Aerial, in Proc. 9th European Microwave Conference, UK, June 1979, pp. 101-105). The original Vivaldi antennae were tapered notch antennas opening in an exponential flare shape intended for operation in the 2 to 20 GHz portion of the radio frequency spectrum.

In the years since the Vivaldi antenna was introduced, substantial research has been done in an effort to apply the Vivaldi antenna over a wide range of specific applications. Although each of these incarnations has an unique set of requirements, it is very common to find Vivaldi antennas constructed on a copper clad printed circuit board where the substrate has been selected based on a trade-off between cost and performance and the size based on typical dimensions for a Vivaldi antenna of $\lambda/2$ wide by $\lambda$ in length where $\lambda$ is at the minimum operating frequency.

The prior art printed circuit board construction permits much flexibility in that additional features can be readily and repeatedly implemented without further burdening the product cost, and many variations have been suggested over the years.

In certain prior art Vivaldi antenna designs, a slot (or notch), open at one end, is formed in the conductive waveguide layer, and the gap between the sides of the slot widens from a minimum at the closed end of the slot (or stub) to a maximum at the open end. The symmetrical exponential flare shape used in a Vivaldi addresses a requirement for a wideband, constant beamwidth antenna. The slot line is commonly crossed by a signal microstrip asserting or picking up the signal across the slot line either directly or via the transformer effect. The antenna points from the open end of the notch in a direction away from the notch and along the axis of symmetry in a manner consistent with an end fire antenna.

The Vivaldi antenna is taught by the prior art to radiate radio frequency electromagnetic waves when the width of the widening slot is approximately equal to $\lambda/2$, which therefore suggests the typical dimensions noted above. The performance of physical implementations of conventional antennas is degraded by a number of complicating factors, and when the size is compromised, the performance is further challenged.

However by taking advantage of the flexibility of the printed circuit board construction, it is practical to reasonably compensate for the imperfections through thoughtfully conceived modifications resulting in relatively high performance in a compact package. It is an object of the present invention to compensate for the imperfections in antenna design by applying inventive, novel, and nonobvious shaping of an invented antenna, to include but not be limited to invented antennae that may be classed as Vivaldi antennae

SUMMARY OF THE INVENTION

Towards these objects and other objects that will be made obvious in light of the present disclosure, consider an invented antenna wherein certain prior art Vivaldi antenna physical characteristics have been inventively modified to afford efficient operation with a VSWR of better than 2:1 over a frequency range of approximately 2:1. A first preferred embodiment of the invented antenna demonstrates operation between about 400 and 900 Megahertz.

The method of the present invention provides enhancements to prior art Vivaldi antenna designs through multiple features which work together to provide improved performance in a compact size. In particular, rather than follow the classic straight line, a slot of the invented antenna has been curved at its origin in order to reduce the length, and a petal shaped section has been added to the signal side in order to narrow and shape the bandwidth.

A first preferred embodiment of the invented antenna includes a dielectric sheet having a waveguide side and an opposing signal side. An electrically conductive plate with a notch in it is positioned upon the waveguide side. This notch has a pair of edges extending to a slot line. On the signal side, along with the signal microstrip and its structure, is a separate complementary petal ("petal") formed of an electrically conductive material. The general purpose of this petal is to shape the bandwidth of the antenna.

A slot antenna generally has three efficient frequency ranges: a low range generally representing the planar VSWR component of the antenna, a medium range generally representing the end fire slot VSWR component of the antenna, and a high range representing the general end fire VSWR component of the antenna. When the slot is shaped in the exponential horn pattern of a Vivaldi antenna, this tends to somewhat widen and merge the two end fire VSWR components of the antenna.

In certain alternate preferred embodiments, the petal is shaped like a triangle and is located on the signal side within the area defined by the notch on the waveguide side. This feature serves to enhance the end fire slot VSWR component of the antenna bandwidth, providing better gain characteristics in this band, while at the same time suppressing the higher frequency general end fire characteristics of the antenna.

In certain preferred embodiments, a microstrip extends from the triangular petal and substantively follows a portion of the slot line on the waveguide side. This feature serves to enhance the bandwidth narrowing and shaping aspects of the petal feature. In a conventional Vivaldi antenna, the slot line extends in a straight line from the Vivaldi horn feature of the antenna and may end in a slot stub feature of some sort. The signal microstrip of this conventional antenna is usually positioned at a right angle to the slot line and crosses it at a right angle. The microstrip extending from the petal of some embodiments of the present invention would interfere with the signal microstrip if added to this conventional design. Instead, the signal microstrip is moved off center of the Vivaldi horn feature and rotated to be parallel to the mouth of the Vivaldi horn feature. The slot line curves through a right angle and crosses the signal microstrip at its off center position.

The right angle turn of the slot line to accomplish the off center and parallel positioning of the signal microstrip can be accomplished by a sharp turn combined with an anti-reflection feature near the turn, but it can also be accomplished by a gradual circular turn. The latter method allows the petal microstrip to better align with the slot line through the turn, and is therefore a preferred embodiment.

In certain preferred embodiments where an antenna is comprised of multiple Vivaldi horns, additional inventive features on the waveguide side of the antenna improve the group characteristics of the Vivaldi horns. The end of the waveguide plate of the PCB opposite the end of the Vivaldi horns tends to be grounded. The size and shape of the ground plane formed between the slot line and the grounded end greatly affects the characteristics of the antenna, especially the planar characteristics. So that the characteristics of this ground plane can remain identical for each of the Vivaldi horns, the ground plane specific to each given Vivaldi horn shape can be separated from a ground strip along the end of the PCB by a narrow ground connection. In this fashion, any number of Vivaldi horns with repeatable characteristics can be combined on a single PCB.

In certain preferred embodiments where an antenna is comprised of multiple Vivaldi horns, additional inventive features on the signal side of the antenna improve the group characteristics of the Vivaldi horns. A balanced network of signal microstrips extending from a single original signal microstrip may be constructed such that the impedance of the original signal microstrip matches the impedance of each of the signal microstrips associated with each Vivaldi horn feature. This improves the transmission and reception characteristics of the Vivaldi horns operating in unison. Generally, a number of Vivaldi horns equal to a power of two is best suited for the application of this impedance balanced signal network. Thus, antennas comprising two or four Vivaldi horns are popular instances of this preferred embodiment.

In certain preferred embodiments, the end fire directional characteristics of the antenna can be focused by the addition of a perpendicular conductive metal plate (hereafter "reflector plate") fastened along the grounded end of the PCB opposite the notch end edge of the PCB.

Other advantages and novel features of the present invention will become apparent from the following detailed description of the invention when considered in conjunction with the accompanying drawings.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

INCORPORATION BY REFERENCE

All publications, patents, and patent applications mentioned in this specification are herein incorporated by reference to the same extent as if each individual publication, patent, or patent application was specifically and individually indicated to be incorporated by reference. U.S. Pat. No. 6,900,770 B2 titled "Combined ultra wideband Vivaldi notch/meander line loaded antenna" issued on May 31, 2005 to Inventor(s) Apostolos, J.; US Patent WO2005013413 A2 titled "Combined ultra wideband Vivaldi notch/meander line loaded antenna" issued on Feb. 10, 2005 to Inventor(s) Apostolos, J.; U.S. Pat. No. 6,842,154 B1 titled "Dual polarization Vivaldi notch/meander line loaded antenna" issued on Jan. 11, 2005 to Inventor(s) Apostolos, J.; US Patent 20050078043 A1 titled "Gapless concatenated vivaldi notch/meander line loaded antennas" issued on Apr. 14, 2005 to Inventor(s) Apostolos et al.; U.S. Pat. No. 6,839,036 B1 titled "Concatenated notch/meander line loaded antennas" issued on Jan. 4, 2005 to Inventor(s) Apostolos et al.; US Patent WO2005013413 A2 titled "Combined ultra wideband vivaldi notch/meander line loaded antenna" issued on Feb. 10, 2005 to Inventor(s) Apostolos et al.; U.S. Pat. No. 6,518,931 B1 titled "Vivaldi cloverleaf antenna" issued on Feb. 11, 2003 to Inventor(s) Sievenpiper, D.; U.S. Pat. No. 7,088,300 B2 titled "Vivaldi Antenna" issued on Aug. 8, 2006 to Inventor(s) Fisher, J; U.S. Pat. No. 9,054,427 B2 titled "Planar Vivaldi antenna array" issued on Jun. 9, 2015 to Inventor(s) Guy et al.; U.S. Pat. No. 9,257,747 B2 titled "Vivaldi-monople antenna" issued on Feb. 9, 2016 to Inventor(s) Flores-Cuadras, J.; US Patent 20140306854 A1 titled "Vivaldi-monople antenna" issued on Oct. 16, 2014 to Inventor(s) Flores-Cuadras, J.; US Patent 20140145890 A1 titled "Antenna Assemblies Including Dipole Elements and Vivaldi Elements" issued on May 29, 2014 to Inventor(s) Ramberg et al.; U.S. Pat. No. 6,525,696 B2 titled "Dual band antenna using a single column of elliptical vivaldi notches" issued on Feb. 25, 2003 to Inventor(s) Powell et al.; U.S. Pat. No. 5,600,332 A titled "Wideband, low frequency, airborne vivaldi antenna and deployment method" issued on Feb. 4, 1997 to Inventor(s) Brown et al.; US Patent WO2016109419 A1 titled "Modified vivaldi antenna with dipole excitation mode" issued on Jul. 7, 2016 to Inventor(s) Piskun, V.; US Patent 20160190691 A1 titled "Modified vivaldi antenna with dipole excitation mode" issued on Jun. 30, 2016 to Inventor(s) Piskun, V.; US Patent WO2015169394 A1 titled "Improved antenna arrangement" issued on Nov. 12, 2015 to Inventor(s) Junttila et al.; US Patent 20130278476 A1 titled "High gain antenna" issued on Oct. 24, 2013 to Inventor(s) Peng et al.; U.S. Pat. No. 8,730,116 B2 titled "High gain antenna" issued on May 20, 2014 to Inventor(s) Peng et al.; US Patent 20140253401 A1 titled "High gain antenna" issued on Sep. 11, 2014 to Inventor(s) Peng et al.; US Patent 20130038495 A1 titled "Broad Band Antennas and Feed Methods" issued on Feb. 14, 2013 to Inventor(s) Benzel et al.; U.S. Pat. No. 5,036,335 A titled "Tapered slot antenna with balun slot line and stripline feed" issued on Jul. 30, 1991 to Inventor(s) Jairam, H; U.S. Pat. No. 8,736,506 B1 titled "Wideband aircraft antenna with extended frequency range" issued on May 27, 2014 to Inventor(s) Brock, D; U.S. Pat. No. 7,498,995 B2 titled "UWB antenna having 270 degree coverage and system thereof" issued on Mar. 3, 2009 to Inventor(s) Kim et al.; U.S. Pat. No. 8,504,135 B2 titled "Traveling-wave antenna" issued on Aug. 6, 2013 to Inventor(s) Bourqui et al.; Y. Yang et al. "Design of Compact Vivaldi Antenna Arrays for UWB See Through Wall Applications", Progress in Electromagnetics Research, PIER 82, pp. 401-418, 2008; Norhayati Hamzah et al, "Designing Vivaldi Antenna with Various Sizes using CST Software", Proceedings of the World Congress on Engineering 2011, Vol. II, WCE 2011, Jul. 6-8, 2011, London, U.K.; Chittajit Sarkar, "Some Parametric Studies on Vivaldi Antenna", International Journal of u- and e-Service, Science and Technology, Vol. 7, No. 4, pp. 323-328, 2014; C. K. Pandey et al, "High Gain Vivaldi Antenna for Radar and Microwave Imaging Applications", International Journal of Signal Processing Systems, Vol. 3, No. 1, pp. 35-39, June 2015; Nurhan T. Tokan, "Performance of Vivaldi Antennas in Reflector Feed Applications", ACES Journal, Vol. 28, No. 9, pp. 802-808, September 2013; M. Ostadrahimi et al, "Investigating a Double Layer Vivaldi Antenna Design for Fixed Array Field Measurement", International Journal of Ultra Wideband Communications and Systems, Vol. 1, No. 4, pp. 282-290, 2010; D. Elsheakh et al, "Ultrawideband Vivaldi Antenna for DVB-T, WLAN and WiMAX Applications", Internal Journal of Antennas and Propagation, Vol. 2014, Article ID 761634, 7 pages, 2014; A. Bayat et al, "A Parametric Study and Design of the Balanced Antipodal Vivaldi Antenna", PIERS Proceedings, pp. 778-782, Aug. 19-23, 2012, Moscow, Russia; M. Agahi et al, "Investigation of a New Idea for Antipodal Vivaldi Antenna Design", International Journal of Computer and Electrical Engineering, Vol. 3, No. 2, pp. 277-281, April 2011; Z. Li et al, "A Wideband End-Fire Conformal Vivaldi Antenna Array mounted on a Dielectric Cone", International Journal of Antennas and Propagation, Vol. 2016, Article ID 9812642, 11 pages, 2016; D. Schaubert et al, "Wideband Vivaldi Arrays for Large Aperture Antennas", Perspectives on Radio Astronomy: Technologies for Large Antenna Arrays, Proceedings of the Conference, pp. 49-57, Apr. 12-14, 1999; C. Deng et al, "Generation of OAM Radio Waves using Circular Vivaldi Antenna Array", International Journal of Antennas and Propagation, Vol. 2013, Article ID 847859, 7 pages, 2013; Y. Song et al, "An 8-element Tapered Slot Antenna Array with a Bandwidth in Excess of 16.5:1", Progress in Electromagnetic Research Symposium Proceedings, PIERS Proceedings, pp. 891-894, Mar. 22-26, 2010; S. Kasturi et al, "Effect of Dielectric Substrate on Infinite Arrays of Single-Polarized Vivaldi Antennas", Proceedings of the 2003 Antenna Applications Symposium, Vol. 1, pp. 162-175, Sep. 17-19, 2003; H. Loui et al, "A Dual-Band Dual-Polarized Nested Vivaldi Slot Array with Multilevel Ground Plane", IEEE Transactions on Antennas and Propagation, Vol. 51, No. 9, pp. 2168-2175, September 2003; S. Sheel et al, "Switchable-Feed Reconfigurable Ultra-Wide Band Planar Antenna", International Symposium on Antennas and Propagation, Nov. 9-12, 2015; and M. Sonkki et al, "Wideband Dual-Polarized Cross-Shaped Vivaldi Antenna", IEEE Transactions on Antennas and Propagation, Vol. 63, Issue 6, pp. 2813-2819, June 2015 are incorporated herein by reference in their entirety and for all purposes.

BRIEF DESCRIPTION OF THE DRAWINGS

These, and further features of the invention, may be better understood with reference to the accompanying specification and drawings depicting the preferred embodiment, in which:

FIG. 1 is a diagram of a conventional Vivaldi antenna;

FIG. 2A illustrates a waveguide layer comprising two Vivaldi horns for a dual element embodiment of the present invention;

FIG. 2B illustrates a right half of the waveguide layer comprising two of four Vivaldi horns of a quad element array embodiment of the present invention;

FIG. 2C illustrates the left half of the waveguide layer comprising two of four Vivaldi horns of the quad element array embodiment of the present invention of FIG. 2B;

FIG. 3A is a diagram of the signal layer for the dual element array embodiment of the present invention of FIG. 2A;

FIG. 3B is a diagram of the signal layer for the right half of the quad element array embodiment of the present invention of FIG. 2B;

FIG. 3C is a diagram of the signal layer for the left half of the quad element array embodiment of the present invention of FIG. 2C;

FIG. 4 is a block diagram of the quad element signal microstrip impedence matching network of FIGS. 2B, 2C, 3B and 3C;

FIG. 5 is an illustration of both sides of the quad element array of FIGS. 4, 2B, 2C, 3B and 3C.

FIG. 7 is a mechanical drawing of an exemplary reflector plate assembly.

DETAILED DESCRIPTION

Figure 6:
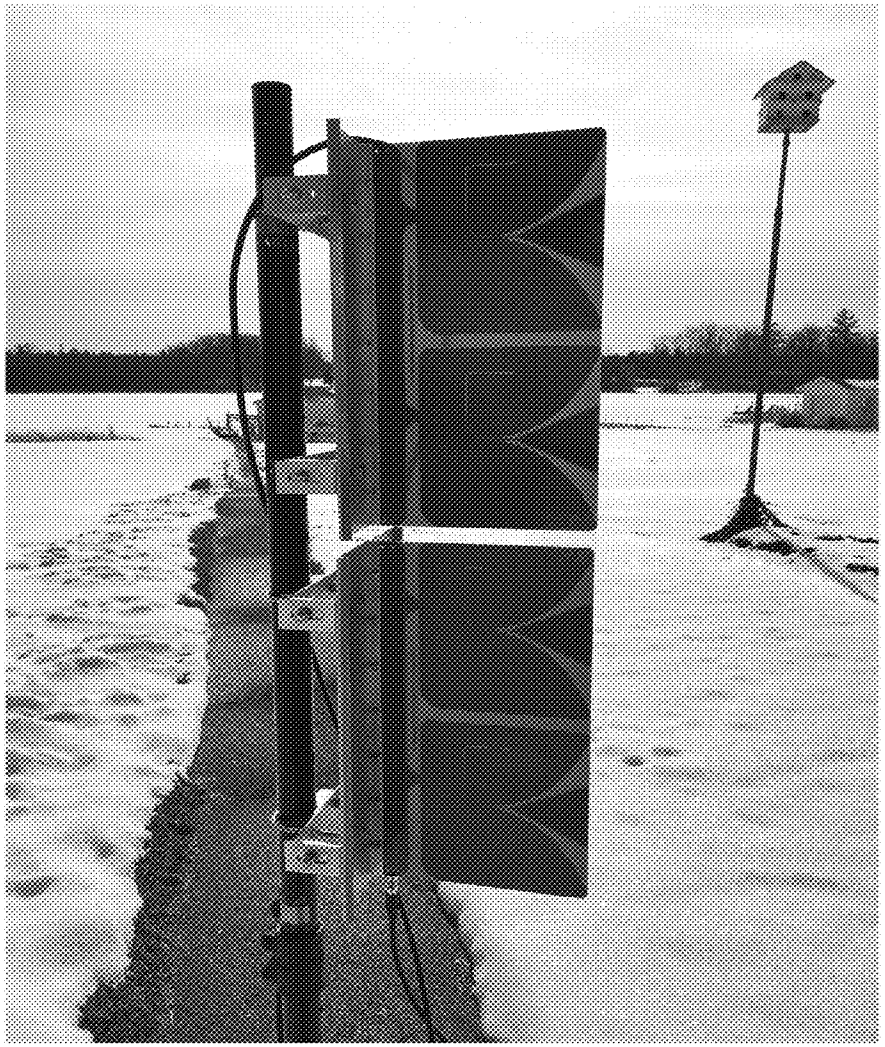
FIG. 6 is a photograph of an exemplary pair of dual element arrays operating as a quad element in a 120 degree backplane producing an 8 decibels-isotropic gain.

FIG. 1 is a diagram showing a conventional Vivaldi antenna implementation 100 including a conducting waveguide layer 102 comprising two symmetrical conducting wings 104 & 106 and a signal microstrip 108 (shown in dotted lines) which is typically placed on the opposite side of a coupled printed circuit board 110. The printed circuit board 110 may comprise a sheet of RF4 high-pressure thermoset plastic laminate material.

Each of the conducting wings 104 & 106 has an inner edge 104E & 106E which is cut away along an exponential curve. A flared notch 112 is thereby formed between the two conducting wings 104 & 106. Radio frequency waves are theorized to radiate from a corresponding point along an axis at which the width of the flared notch is equal to $\lambda/2$.

FIG. 2A is a diagram of the waveguide layer for one embodiment of the present invention 200 (hereinafter, "the dual element array" 200) incorporating dual Vivaldi horns 202A & 202B formed into an array. The familiar exponentially increasing slot (1, 2, and 11, 12) and symmetrical wings (4, 14 and 16, 17) are readily apparent on each of the Vivaldi horns; however there are several distinctions. For the short circuit end of the slot, the conventional circular aperture is replaced by a slot line of the appropriate length and shape (3, 13). Furthermore rather than extend in straight line, the slot line has been curved (5, 15) to accommodate the off center signal microstrip (see FIGS. 3A 24 and 34) and make room for the triangular petal microstrip (see FIGS. 3A 23 and 33) on the other side of the PCB. Finally, as a matter of practicality the ground plane has been extended through a strategically placed narrow section (6, 18) from the ground connection (7) to normalize the antenna design between the two sides of the dual element array.

FIG. 2B is a partial view of the waveguide layer for another embodiment of the present invention 204 (hereinafter, "the quad element array" 204) incorporating four Vivaldi horns 204A-204D formed into an array 208, wherein FIG. 2B shows only two Vivaldi horns 204A & 204B of a right side 206A of the quad element array 202. The familiar exponentially increasing slot (1, 2, and 11, 12) and symmetrical wings (4, 14 and 16, 17) are readily apparent on these two Vivaldi horns; however there are several distinctions. For the short circuit end of the slot, the conventional circular aperture is replaced by a slot line of the appropriate length and shape (3, 13). Furthermore rather than extend in straight line, the slot line has been curved (5, 15) to accommodate the off center signal microstrip (see FIGS. 3A 24 and 34) and make room for the triangular petal microstrip (see FIGS. 3A 23 and 33) on the other side of the PCB. Finally, as a matter of practicality the ground plane has been extended through a strategically placed narrow section (6, 18) from the ground connection (7) to normalize the antenna design among the four Vivaldi horns of the quad element array.

FIG. 2C is a partial view of the quad element array 204 that shows only another two Vivaldi horn features 204C & 204D of a left side 206B of the quad element array 204. It is understood that the ground connection (7) extends to be electrically coupled with all four of the Vivaldi horns 204A-204D of the quad element array 204. The familiar exponentially increasing slot (1, 2, and 11, 12) and symmetrical wings (4, 14 and 16, 17) are readily apparent on these two elements; however there are several distinctions. For the short circuit end of the slot, the conventional circular aperture is replaced by a slot line of the appropriate length and shape (3, 13). Furthermore rather than extend in straight line, the slot line has been curved (5, 15) to accommodate the off center signal microstrip (see FIGS. 3A 24 and 34) and make room for the triangular petal microstrip (see FIGS. 3A 23 and 33) on the other side of the PCB. Finally, as a matter of practicality the ground plane has been extended through a strategically placed narrow section (6, 18) from the ground connection (7) to normalize the antenna design among the four Vivaldi horns of the quad element array.

FIG. 3A is a diagram of a signal layer 300 for the dual element array 200 of FIG. 2A. Although the signal is conveyed via a conventional microstrip line, several distinctive features are noted. In particular a pair of sections of a conductive plate, wherein each section shaped as a martini glass petal (21, 31) have been added along with a petal microstrip (23,33) which serves to enhance the end fire characteristics of the slot while suppressing the high frequency end fire characteristics of the antenna as a whole. For completeness a ground connection microstrip (18) and ground backplane (28), combiner (27, 37), microstrip transmission lines (26, 36, 24, 34), matching impedance matchers (double check this term) (25, 35), and anti-reflection stubs (double check this term) (22, 32) are each illustrated and denoted.

FIG. 3B is a diagram of a right side 302A of a signal layer 300 for the right side 206A of the quad element array 204 of FIG. 2B. Although the signal is a conventional microstrip, several distinctive features are noted. In particular a pair of petals (21, 31) have been added along with petal microstrips (23,33) which serve to enhance the bandwidth quad element array 204. For completeness a ground connection microstrip (18) and a ground backplane (28), each combiner (27, 37), each of the microstrip transmission lines (26, 36, 24, 34), each of the impedance matchers (double check this term) (25, 35), and each of the anti-reflection stubs (double check this term) (22, 32) are each illustrated and denoted.

FIG. 3C is a diagram of a left side 302B of the signal layer 300 for the left side 206B of the quad element array 204 of FIG. 2B. Although the signal is conveyed via a conventional microstrip line, several distinctive features are again present and noted. In particular another two petals (21, 31) have been added along with another petal microstrip (23,33) which serve to enhance the bandwidth of the quad element array 204. For completeness the ground connection microstrip (18) and the ground backplane (28), the combiner (27, 37), the microstrip transmission lines (26, 36, 24, 34), the impedance matchers (25, 35), and the anti-reflection stubs (double check this term) (22, 32) are each illustrated and denoted.

FIG. 4 is a block diagram of the four bay quad element array 204 having four signal microstrips 204A-204D, and in particular, this diagram shows the entire impedance matching network between the original signal microstrip and the four impedance balanced microstrips of the four elements. A first reactive three-port transformer 402A is electrically coupled with and disposed between the right two signal microstrips 204A & 204B and a second reactive three-port transformer 402B. A third reactive three-port transformer 402C is electrically coupled with and disposed between the left two signal microstrips 204C & 204D and the second reactive three-port transformer 402B.

The second reactive three-port transformer 402B is electrically coupled with and disposed between the first reactive three-port transformer 402A, the third reactive three-port transformer 402C and a radio frequency conductive connector 404.

FIG. 5 is an illustration of the four bay quad element array 204.

FIG. 6 is a photograph of an exemplary four bay quad element array 600 of a quad element array consisting of two joined dual element arrays in a 120 degree backplane producing an 8 decibels-isotropic gain.

FIG. 7 is a top view drawing of an exemplary reflector plate assembly 600 including the reflector plate itself 602 and the PCB 604 as heretofore described. The reflector plate serves to limit the transmission/reflection angle of the antenna to at most the end-facing 180 degree arc. Different widths or shapes of this reflector plate may further focus the horizontal angle of transmission/reception.

The foregoing embodiment and description considered the arrangement of a dual and quad element antenna. It will be understood that antennae in accordance with the present invention can be used as individual elements or as part of an antenna array and in orthogonal pairs for dual-polarised functionality. As such the present invention is also considered applicable to arrays of dual-polarised antenna pairs as well as single elements.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Additionally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based herein. Accordingly, the disclosure of the embodiments of the invention is intended to be illustrative, but not limiting, of the scope of the invention, which is set forth in the following claims.

What is claimed is:

1. An antenna comprising:

a coplanar dielectric sheet having a waveguide layer and a signal layer on opposite sides;

at least one waveguide element of a Vivaldi horn disposed upon the waveguide layer;

at least one structure disposed upon the signal layer, the structure including a triangular petal (hereafter "petal") disposed within the area of the dielectric sheet defined by the pair of edges of the notch of the Vivaldi horn on the opposite layer.

2. The antenna of claim 1, wherein the waveguide element includes a narrower conducting feature that is disposed between and electrically connects the horn element and the ground backplane.

3. The antenna of claim 2, wherein the at least one signal layer structure further comprises a microstrip extending from the petal.

4. The antenna of claim 3, wherein the signal microstrip and the antenna slot line cross at a right angle while maintaining the displacement imposed by the planar dielectric sheet.

5. The antenna of claim 3, wherein the antenna slot line comprises a point of origin and an endpoint, wherein the point of origin of the antenna slot line is located at a narrowest aperture location defined by the Vivaldi horn element.

6. The antenna of claim 3, wherein the antenna slot line is positioned opposite the signal microstrip extending from the Petal.

7. The antenna of claim 1, wherein the petal is adapted to limit an operational bandwidth of the antenna to twice the value of a selected lowest operational frequency value established by the Vivaldi horn.

8. The antenna of claim 7, wherein the petal is shaped to reside within an open area defined by the Vivaldi horn on the opposite layer while the displacement imposed by the planar dielectric sheet between the at least one waveguide element and the at least one signal layer structure is maintained.

9. The antenna of claim 8, wherein a microstrip extends from the petal and toward the signal microstrip.

10. The antenna of claim 9, wherein the slot line of the Vivaldi horn is disposed between the petal and a terminus of the petal microstrip.

11. The antenna of claim 10, wherein the petal microstrip capacitively couples the slot line of the Vivaldi horn and the petal.

12. The antenna of claim 9, wherein a terminus of the petal microstrip is positioned proximate to a crossing point of the antenna slot line and the signal microstrip.

13. The antenna of claim 9, wherein the petal microstrip is positioned and adapted to receive signal energy from the antenna slot line.

14. The antenna of claim 2, wherein the signal microstrip is coupled to the antenna slot line at an off-center location.

15. The antenna of claim 3, wherein the at least one signal layer structure further comprises at least one feature adapted to reduce signal energy reflections at a bend of the signal microstrip.

* * * * *